US009202679B2

(12) United States Patent
Kalinitchenko et al.

(10) Patent No.: US 9,202,679 B2
(45) Date of Patent: Dec. 1, 2015

(54) ELECTRICALLY CONNECTED SAMPLE INTERFACE FOR MASS SPECTROMETER

(75) Inventors: Iouri Kalinitchenko, Berwick (AU); Peter Zdaril, Hallam (AU)

(73) Assignee: Analytik Jena AG, Jena (DE)

( * ) Notice: Subject to any disclaimer, the term of this patent is extended or adjusted under 35 U.S.C. 154(b) by 18 days.

(21) Appl. No.: 13/988,511

(22) PCT Filed: Nov. 25, 2011

(86) PCT No.: PCT/AU2011/001529
§ 371 (c)(1),
(2), (4) Date: May 21, 2013

(87) PCT Pub. No.: WO2012/068632
PCT Pub. Date: May 31, 2012

(65) Prior Publication Data

US 2013/0248701 A1 Sep. 26, 2013

(30) Foreign Application Priority Data

Nov. 26, 2010 (AU) ..... 2010905248

(51) Int. Cl.
*H01J 49/06* (2006.01)
*H01J 49/10* (2006.01)

(52) U.S. Cl.
CPC ..... *H01J 49/06* (2013.01); *H01J 49/067* (2013.01); *H01J 49/105* (2013.01)

(58) Field of Classification Search
CPC ..... H01J 49/067; H01J 49/06; H01J 49/105
USPC ..... 250/281, 288
See application file for complete search history.

(56) References Cited

U.S. PATENT DOCUMENTS

| | | | | |
|---|---|---|---|---|
| 5,218,204 | A | 6/1993 | Houk et al. | |
| 5,614,711 | A | 3/1997 | Li et al. | |
| 6,140,638 | A | 10/2000 | Tanner et al. | |
| 6,614,021 | B1 * | 9/2003 | Kalinitchenko | 250/294 |
| 7,176,455 | B1 | 2/2007 | Whitehouse et al. | |
| 2004/0124353 | A1 | 7/2004 | Tanner et al. | |
| 2005/0173628 | A1 * | 8/2005 | Ahern et al. | 250/288 |
| 2007/0114382 | A1 * | 5/2007 | Clemmer et al. | 250/287 |
| 2009/0218486 | A1 | 9/2009 | Whitehouse et al. | |
| 2010/0042334 | A1 * | 2/2010 | Rardin et al. | 702/27 |

FOREIGN PATENT DOCUMENTS

WO 9962101 A1 12/1999

OTHER PUBLICATIONS

Tanner, S. D., et al., Reaction cells and collision cells for ICP-MS: a tutorial review, Spectrochimica Acta Part B 57 Jun. 20, 2002, 1361-1452.

* cited by examiner

*Primary Examiner* — Brooke Purinton
(74) *Attorney, Agent, or Firm* — Robic, LLP

(57) ABSTRACT

There is provided a sampling interface for use with a mass spectrometry apparatus. The sampling interface is arranged so as to enable the sampling of ions in a mass spectrometer. In one aspect, the sampling interface comprises an inlet for receiving a quantity of ions from an ion source, and a region downstream of the inlet for accommodating a gas through which the ions may pass, wherein a field having a selected bias voltage potential is provided in at least a portion of the downstream region through which the ions may pass.

30 Claims, 6 Drawing Sheets

ELECTRICALLY CONNECTED SAMPLE INTERFACE FOR MASS SPECTROMETER

FIELD OF THE INVENTION

The present invention concerns improvements in or relating to mass spectrometry. More particularly, the invention relates to improvements to sampling interfaces for use with mass spectrometry apparatus. In one aspect, the present invention relates to a sampling interface for use with an inductively coupled plasma mass spectrometer.

BACKGROUND OF THE INVENTION

In this specification, where a document, act or item of knowledge is referred to or discussed, this reference or discussion is not an admission that the document, act or item of knowledge or any combination thereof was at the priority date part of common general knowledge, or known to be relevant to an attempt to solve any problem with which this specification is concerned.

Mass spectrometers are specialist devices used to measure or analyse the mass-to-charge ratio of charged particles for the determination of the elemental composition of a sample or molecule containing the charged particles.

A number of different techniques are used for such measurement purposes. One form of mass spectrometry involves the use of an inductively coupled plasma (ICP) torch for generating a plasma field into which a sample to be measured or analysed is introduced. In this form, the plasma vaporises and ionizes the sample so that ions from the sample can be introduced to a mass spectrometer for measurement/analysis.

As the mass spectrometer requires a vacuum in which to operate, the extraction and transfer of ions from the plasma involves a fraction of the ions formed by the plasma passing through an aperture of approximately 1 mm in size provided in a sampler, and then through an aperture of approximately 0.4 mm in size provided in a skimmer (typically referred to as sampler and skimmer cones respectively).

A number of problems are known to exist with prior art mass spectrometer arrangements, which have been observed to reduce their measurement sensitivity.

For example, in the case of plasma mass spectrometry, typical plasma oscillating frequencies are 27 or 40 MHz. Plasma produced by balanced, symmetrically driven, or interlaced coils arrangements is considered to be quasi-neutral, having a relatively low oscillating plasma potential.

However, due to differences in electron mobility as compared with ion mobility, the plasma may in some cases obtain a low positive direct current potential while traveling between the sampler and skimmer cones.

It is thought that this can occur as a result of electrons moving faster than ions when leaving the plasma.

A phenomenon known as ambipolar drift has also been observed to introduce an excessive number of positive ions as compared with the number of electrons during expansion of the plasma jet downstream of the sampler cone.

This can be problematic when charged plasma passes through the skimmer when the skimmer is arranged in a grounded configuration. In such cases, the plasma tends to readjust its potential to a lower state. Accordingly, the plasma has a tendency to eject an excessive amount of ions from the plasma thereby inducing ion recombination with the grounded skimmer. In these situations, ion losses and a drop in measurement sensitivity is almost inevitable.

Another problem with prior art arrangements is collisional scattering. Mass-spectrometers normally operate in a residual gas atmosphere, where gas particles of collisional gases often collide with passing ions which divert or scatter the ions from their intended direction of travel. Collisions of this nature can result in reduced signal sensitivity. Some mass spectrometers utilise specific collisional/reactive cells (a pressurized atmosphere often arranged in conjunction with multi-pole ion guidance systems) to manipulate, control and/or filter the ion beam. In such cases, collisional scatter also becomes a problem where such collisional gases are held under pressure.

SUMMARY OF THE INVENTION

According to a first principal aspect of the present invention, there is provided a sampling interface for use with a mass spectrometry apparatus, the sampling interface being arranged so as to enable the sampling of ions in a mass spectrometer for subsequent spectrometric analysis, the sampling interface comprising:

an inlet for receiving a quantity of ions from an ion source; and a region downstream of the inlet for accommodating a gas through which the ions may pass;

wherein a field having a selected bias voltage potential is provided in at least a portion of the downstream region through which the ions may pass.

The bias voltage potential of the field may be a positive bias voltage potential.

Typically an energy component of the ions will be increased as they pass through the field charged in this way.

The bias voltage potential of the field may be selected so as to reduce collisional scatter caused when ions collide with particles of the gas as the ions pass through the field in the downstream region.

In one embodiment of this aspect of the invention, the bias voltage potential of the field may be selected in accordance with a correlation with a change in kinetic energy of the ions due to collisions with particles of the gas as the ions pass through the downstream region so as to reduce collisional scatter.

In another embodiment, the bias voltage potential of the field is selected such that the signal strength (or sensitivity) of ions which reach a detector of the mass spectrometry apparatus is as strong as possible. Accordingly, when the signal strength is at a maximum, the degree of collisional scatter should be at a minimum.

In one embodiment, the bias voltage potential applied to the field is a function of the loss of ion energy due to ionic collisions which occur in the downstream region.

In another embodiment of this aspect of the invention, the bias voltage potential of the field may be selected in accordance with a correlation with the pressure of gas in the downstream region so as to reduce collisional scatter. In this embodiment the bias voltage potential of the field may be arranged so as to be variable in response to variation in the pressure of the gas in the downstream region.

A change in the pressure of the gas in the downstream region, such as an increase in pressure, may cause a commensurable increase in the number of ionic collisions which occur. Therefore, in one embodiment, a change in the bias voltage potential applied to the field may be selected so as to be commensurable with any change, such as an increase, in the pressure of the gas in the downstream region. However, the commensurable increase in the number of ionic collisions which occur as a result of an increase in gas pressure in the downstream region may not translate to the same increase in collisional scatter of the ions. This is because collisional scatter is generally a function of ion energy and/or the speed of an ion prior to a collision.

Accordingly, the bias voltage potential to be applied to the field will generally be a function of the collisional scatter of the ions due to ionic collisions and, in at least one embodiment, may be selected so as to determine the magnitude of the bias voltage potential which results in the maximum possible number of ions reaching the detector of a mass spectrometry apparatus (ie. minimizing collisional scatter).

It will be appreciated that any magnitude of bias voltage potential may be applied to the field.

Although other arrangements are envisaged, the downstream region will typically be, at least in part, defined by a chamber arranged to be sealed so that the enclosed gas or gases reside in the chamber under pressure.

In one typical embodiment the downstream region is, or forms part of, a collision reaction interface (CRI).

Typically the ion source will be a plasma generated by an inductively coupled plasma (ICP), although other ion sources are envisaged within the scope of the invention. The field density of the plasma generated by the ICP will typically range from about 1 to 4 V/cm.

In one embodiment of the above described aspects of the invention, the interface may be arranged so as to be in electrical communication with a voltage source so that the bias voltage potential may be applied to the field. The voltage source may be separate from the interface, or it may be arranged with the interface.

In a further embodiment of the above described aspects of the invention, the bias voltage potential of the field may be provided by a chargeable element arranged so as to be electrically coupleable to the voltage source. In this embodiment the chargeable element is arranged within the region so that the field is positioned relative to a desired pathway of the ions, so that passing ions gain energy potential from the field.

In one such embodiment, the chargeable element may have an aperture provided therein through which ions may pass.

In another embodiment, the chargeable element is arranged so as to be electrically isolated from ground.

The voltage potential applied to the chargeable element may be a positive voltage potential.

The chargeable element may be supported from the inlet. In one arrangement, the chargeable element is supported on the downstream side of the inlet.

The region will typically be, at least in part, defined by a chamber arranged to be sealed so that the enclosed gas or gases reside in the chamber under pressure.

In another typical embodiment, the chargeable element is electrically isolated from the walls of the chamber defining the downstream region.

Where the downstream region is defined by a chamber, the chargeable element will typically be supported by one or more of the chamber walls.

The gas accommodated in the downstream region may be at least one of helium or hydrogen as is typically known in the art, or a mixture thereof. Another suitable gas or mixtures of two or more other suitable gases may be accommodated in the downstream region as desired.

In one embodiment, the inlet for receiving said quantity of ions may be substantially conical in shape having an aperture provided at or near the apex of the cone. The chargeable element may also be substantially conical in shape also having an aperture provided at or near the apex of the cone. In this arrangement, the apertures of both the inlet and the chargeable element are arranged so as to be substantially concentric with one another.

According to one embodiment, the inlet is a sampler having a sampler cone, and the chargeable element is a skimmer having a skimmer cone.

The chamber will typically be arranged adjacent a downstream face of the sampler.

In a further embodiment, the chamber includes an inlet through which gas or a mixture of gases may be injected into the chamber. In one embodiment of this arrangement, the chargeable element has an inlet through which gas may be injected into the chamber.

According to further embodiments, the chamber may include an ion optics arrangement positioned generally downstream of the inlet. Suitable ion optics arrangements may include, but are not limited to, a 'chicane' or 'mirror' type ion optics arrangement.

Any of the arrangements of the sampling interface described herein may include one or more collision cells. The or each collision cell may be arranged so as to accommodate one or more reaction or collision gases such as ammonia, methane, oxygen, nitrogen, argon, neon, krypton, xenon, helium or hydrogen, or mixtures of any two or more of them, for reacting with ions extracted from the plasma. It will be appreciated that the latter examples are by no means exhaustive and that many other gases, or combinations thereof, may be suitable for use in such collision cells.

The bias voltage potential of the field may be arranged so as to be variable in response to variations in the pressure of the gas or gases provided in the or each collision cell.

The or each collision cell may include one or more quadrupole arrangements.

The ions for measurement may be sourced from a plasma. In one embodiment the ions are sourced from a plasma generated by an inductively coupled plasma (ICP).

According to a further aspect of the present invention there is provided a sampling interface according to embodiments of the first principal aspect of the invention, wherein the interface is arranged so as to be associable with at least one of the following mass spectrometry instrumentation: atmosphere pressure plasma ion source (low pressure or high pressure plasma ion source can be used) mass spectrometry such as ICP-MS, microwave plasma mass spectrometry (MP-MS) or glow discharge mass spectrometry (GD-MS) or optical plasma mass spectrometry (for example, laser induced plasma), gas chromotography mass spectrometry (GC-MS), liquid chromotography mass spectrometry (LC-MS), and ion chromotography mass spectrometry (IC-MS). Furthermore, other ion sources may include, without limitation, electron ionization (EI), direct analysis in real time (DART), desorption electro-spray (DESI), flowing atmospheric pressure afterglow (FAPA), low temperature plasma (LTP), dielectric barrier discharge (DBD), helium plasma ionization source (HPIS), spheric pressure photo-ionization (DAPPI), and atmospheric description ionization (ADI). The skilled reader will appreciate that the latter list is not intended to be exhaustive, as other developing areas of mass spectrometry may benefit from the principles of the present invention.

According to a further aspect of the invention there is provided a mass spectrometer having a sampling interface arranged according to any of the embodiments of the first principal aspect of the invention.

According to a further aspect of the invention there is provided an inductively coupled plasma mass spectrometer having a sampling interface according to any of the embodiments of the first principal aspect of the invention.

According to a second principal aspect of the invention there is provided a plasma sampling interface for a plasma mass spectrometry apparatus, the plasma sampling interface arranged so as to enable the sampling of ions from a plasma and introduction of the ions to a mass spectrometer for subsequent spectrometric analysis, the ions to be sampled being from a sample which has been converted into ions in the plasma, the plasma sampling interface comprising:

a sampler arranged adjacent the plasma for receiving ions therefrom; and a region downstream of the sampler arranged to accommodate a gas through which ions received from the plasma may pass;

wherein at least a portion of the downstream region is arranged so as to provide a field having a selected bias voltage potential through which the ions may pass.

In one embodiment of this second principal aspect of the invention a skimmer is provided and arranged downstream of the sampler. Both the sampler and skimmer are arranged so as to enable sampling of ions from the plasma for introduction to the mass spectrometer.

The interface may be further arranged so as to be in electrical communication with a voltage source, so that the bias voltage potential may be applied to the field. The voltage source may be separate from the interface, or it may be arranged with the interface.

In one embodiment, the bias voltage potential of the field is provided by way of a chargeable element such as a skimmer or skimmer cone, the chargeable element therefore being arranged in electrical communication with the voltage source.

The bias voltage potential of the field may be selected so as to reduce collisional scatter caused when ions collide with particles of the gas as the ions pass through the downstream region.

In one embodiment of this second principal aspect of the invention, the bias voltage potential applied to the skimmer (or chargeable element) may be selected in accordance with a correlation with a change in kinetic energy of the ions due to collisions with gas particles as the ions pass through the downstream region.

In another embodiment of this second principal aspect of the invention, the bias voltage potential applied to the skimmer (or chargeable element) may be selected so as to reduce collisional scatter caused when ions collide with particles of the gas as the ions pass through the downstream region.

In another embodiment of this second principal aspect of the invention, the bias voltage potential applied to the skimmer (or chargeable element) may be selected in accordance with a correlation with the pressure of the gas in the region so as to reduce collisional scatter.

In one typical embodiment, the voltage source is arranged so that the bias voltage potential applied to the skimmer may vary in response to variation in the pressure of the gas in the region.

In another embodiment, the skimmer is arranged so as to be electrically isolated from ground. The bias voltage potential applied to the skimmer may be a positive bias voltage potential.

The skimmer may be supported from the inlet. In one arrangement the chargeable element is supported on the downstream side of the inlet.

In one embodiment the downstream region is, at least in part, defined by a chamber arranged to be sealed so that the enclosed gas or gases reside in the chamber under pressure. The skimmer will typically be supported by one or more of the chamber walls, and may be electrically isolated from the walls of the chamber.

The skimmer may be substantially conical in shape having an aperture provided at or near the apex of the cone. The sampler, if present, may also be substantially conical in shape and having an aperture provided at or near the apex of the cone. In this embodiment the apertures of the inlet and the chargeable element are arranged so as to be substantially concentric with one another.

In another embodiment, the chamber is arranged adjacent a downstream face of the skimmer.

In a further embodiment, the chamber includes an inlet through which the gas or mixture of gases may be injected into the chamber. The skimmer may be provided with an inlet through which gas may be injected into the chamber.

According to further embodiments, the chamber may include an ion optics arrangement positioned generally downstream of the skimmer. Suitable ion optics arrangements may include, but are not limited to, a 'chicane' or 'mirror' type ion optics arrangement.

Embodiments of the second aspect of the invention may comprise one or more of the arrangements of the first principal aspect of the invention described above.

According to a further aspect of the present invention there is provided a mass spectrometer having a sampling interface arranged according to any of the embodiments of the second principal aspect of the invention.

According to a further aspect of the present invention there is provided an inductively coupled plasma mass spectrometer having a plasma sampling interface according to any of the embodiments of the second principal aspect of the invention.

According to a further aspect of the present invention, there is provided a method for attenuating directional deviation of ions of a directed ion beam from a desired pathway in a mass spectrometer having an ion source for producing the directed ion beam, detection means, at least one apertured interface between the ion source and the detection means through which the directed ion beam passes, and a chamber into which a gas is capable of being introduced, the method comprising applying a voltage to bias ions of the directed ion beam in the direction of the desired pathway as the directed ion beam passes into the chamber downstream of the apertured interface.

According to a further aspect of the present invention there is provided a method for controlling the desired pathway of ions of a directed ion beam in a mass spectrometer having an ion source for producing the directed ion beam, detection means, at least one apertured interface between the ion source and the detection means through which the directed ion beam passes, and a chamber into which a gas is capable of being introduced, the method comprising creating an electrical field in the region of the apertured interface so as to bias ions of the directed ion beam towards the desired pathway as the directed ion beam passes into the chamber downstream of the apertured interface.

According to a further aspect of the present invention there is provided a sampling interface for use in sampling ions in a mass spectrometer having an ion source for producing a directed ion beam along a desired pathway, detection means, and a chamber into which a gas is capable of being introduced, the interface being apertured and electrically coupleable to a voltage source so as to bias ions of the directed ion beam towards the desired pathway as the directed ion beam passes into the chamber downstream of the apertured interface.

According to a further aspect of the present invention there is provided a mass spectrometer having an ion source for producing a directed ion beam along a desired pathway, detection means, at least one apertured interface between the ion source and the detection means through which the directed ion beam passes, and a chamber downstream of the apertured interface into which a gas is capable of being introduced, wherein the apertured interface is electrically coupleable to a voltage source so as to bias ions of the directed ion beam towards the desired pathway as the directed ion beam passes into the chamber downstream of the apertured interface.

BRIEF DESCRIPTION OF THE DRAWINGS

Embodiments of the invention will now be further explained and illustrated, by way of example only, with reference to any one or more of the accompanying drawings in which.

DETAILED DESCRIPTION

For brevity, several embodiments of a sampling interface, as arranged in accordance with the present invention, will be described with specific regard to inductively coupled mass spectrometry (ICP-MS) devices. However, it will be appreciated that such sampling interface arrangements may be readily applied to any mass spectrometry instrumentation, including those having any type of collision atmosphere (including, but not limited to multi-pole collision or reaction cells) arrangements used for selective ion particle fragmentation, attenuation, reaction, collision scattering, manipulation, and redistribution with the purpose of mass-spectra modification. Accordingly, the following mass spectrometry devices may benefit from the principles of the present invention: atmosphere pressure plasma ion source (low pressure or high pressure plasma ion source can be used) mass spectrometry such as ICP-MS, microwave plasma mass spectrometry (MP-MS) or glow discharge mass spectrometry (GD-MS) or optical plasma mass spectrometry (for example, laser induced plasma), gas chromotography mass spectrometry (GC-MS), liquid chromotography mass spectrometry (LC-MS), and ion chromotography mass spectrometry (IC-MS). The skilled reader will appreciate that the latter list is not intended to be exhaustive, as other developing areas of mass spectrometry may benefit from the principles of the present invention.

By way of brief explanation, in the case of ICP-MS devices, a 'Campargue' type configuration plasma sampling interface is often utilized to provide for the production and transfer of ions from a test sample to a mass spectrometer. An interface of this configuration generally consists of two electrically grounded components: a first component generally referred to as a sampler (or sampler cone), which is placed adjacent the plasma to serve as an inlet for receiving ions produced by the plasma; and, a second component commonly known as a skimmer (or skimmer cone), which is positioned downstream of the sampler so that ions pass there through en-route to the mass spectrometer. The skimmer generally includes an aperture through which the ions pass. The purpose of the sampler and skimmer arrangement is to allow the ions to pass (via respective apertures) into a vacuum environment required for operation by the mass spectrometer. The vacuum is generally created and maintained by a multi-stage pump arrangement in which the first stage attempts to remove most of the gas associated with the plasma. One or more further vacuum stages may be used to further purify the atmosphere prior to the ions reaching the mass spectrometer. In most systems, an ion optics or extraction lens arrangement is provided and positioned immediately downstream of the skimmer for separating the ions from UV photons, energetic neutrals, and any further solid particles that may be carried into the instrument from the plasma.

Figure 1:
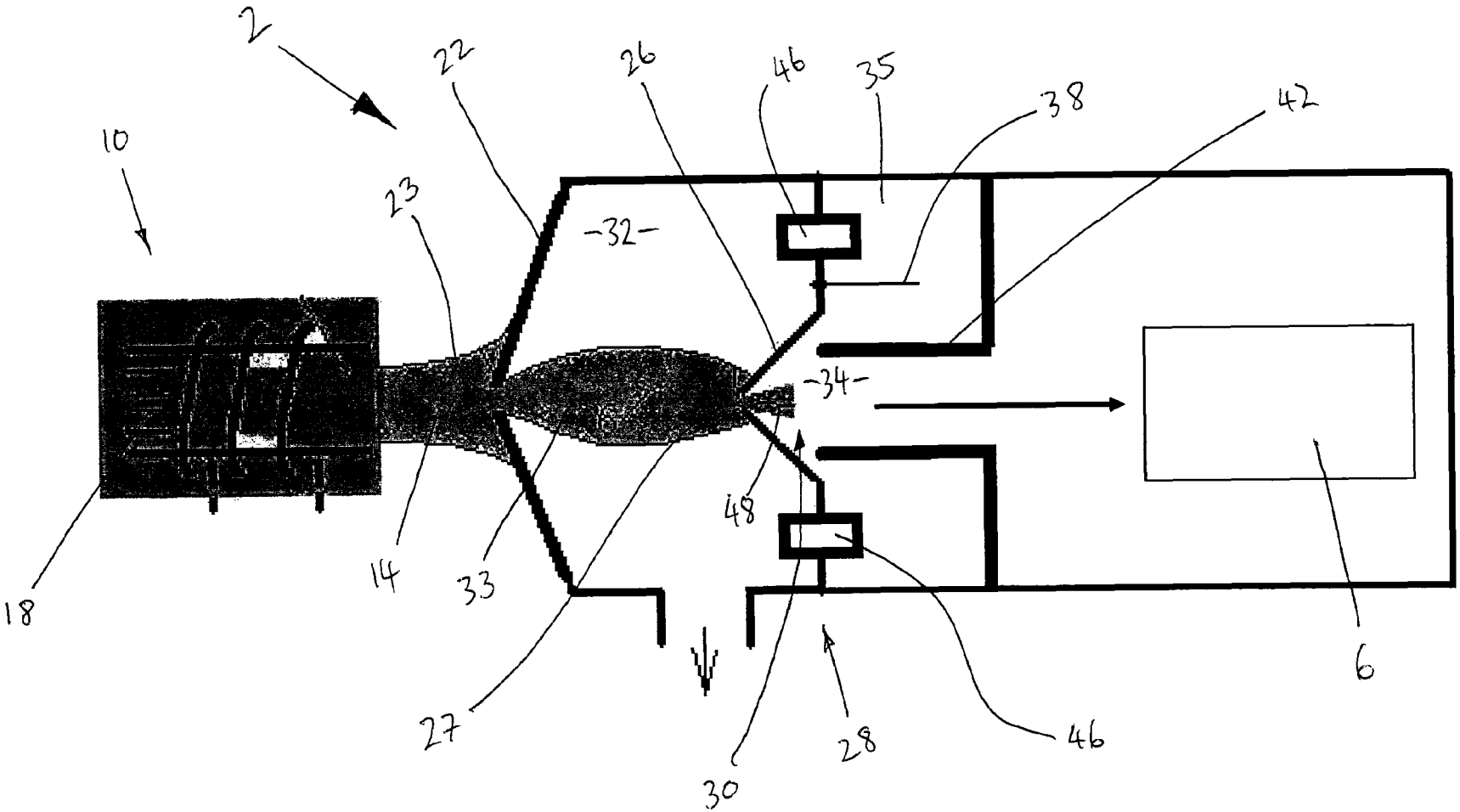
FIG. 1 shows a schematic representation of an inductively coupled plasma mass spectrometry (ICP-MS) apparatus arranged in accordance with one embodiment of the present invention.

FIG. 1 shows one embodiment of a sampling interface 2, arranged in accordance with the present invention, as configured using a two aperture ICP-MS 'Campargue' interface arrangement for use with an ICP-MS device. An ICP torch 10 is provided in order to produce a plasma field 14. During operation, a test sample 18 is introduced into the plasma field 14 where the sample is vaporised and converted into ions for analysis by mass spectrometer detector 6. It will be appreciated that the method of producing the ions will depend upon the type of mass spectrometry instrumentation considered, however, for the present purposes, the ions emanate from the plasma. It will be appreciated that various methods of producing the test sample 18 are known in the art and will not be discussed further herein.

Ions from the test sample 18 are sampled from the plasma field 14 by the sampling interface 2. For the embodiment shown in FIG. 1, the sampling interface 2 includes an inlet such as, in the case of an ICP-MS arrangement, a sampler 22 (or sometimes referred to in the art as a sampler cone) arranged adjacent the plasma torch 10 for receiving ions from the plasma field 14. Plasma 14, initially at atmospheric pressure, expands as a plasma expansion jet 33 within a first vacuum chamber 32 (typical pressure being in the order of from 1-10 Torr).

A region (hereinafter collisional region 30), provided within a second chamber 35 downstream of the sampler 22, accommodates a gas (hereinafter collisional gas 34) through which the ions pass. At least a portion of the collisional region 30 is arranged so as to provide a field having a selected bias voltage potential through which the ions may pass. This arrangement allows an energy component of the ions to be increased as they pass through the field. For the embodiment shown in FIG. 1, the bias voltage potential of the field is provided by way of a chargeable element such as a skimmer 26 (in the case of an ICP-MS arrangement) being arranged in electrical communication with a voltage source 38.

Skimmer 26 (or sometimes referred to in the art as a skimmer cone) is generally positioned downstream of the sampler 22. Sampler 22 and the skimmer 26 are arranged relative one another so as to enable sampling of the ions from the plasma field 14 for introduction to the mass spectrometer detector 6. The distance between respective apertures 23, 27 of the sampler 22 and the skimmer 26 can be between 5-30 mm. Skimmer 26 is arranged so that it is isolated from the sampling interface 2 and allowed to 'float' by way of an isolating assembly 28 using isolators 46.

The voltage potential applied to the skimmer 26 is selected in accordance with a correlation with the kinetic energy losses suffered by the ions caused by the effects of collisional scattering as the ions pass into the collisional region 30. The collisional gas 34 is selected based on its suitability for removing unwanted particles from the ion beam such as polyatomic ions in the passing plasma region 48. Using this arrangement, kinetic energy losses of the ions (as a result of the collisions with gas particles) can be compensated for by the application of the bias voltage potential to the skimmer 26 thereby serving to increase an energy component of the ions. In one embodiment, the higher the pressure of the gas provided in the collisional region 30, the higher the bias voltage potential to be applied to skimmer 26 in order to give the ions sufficient energy to minimise collisional scatter in the event of collisions with gas particles. This arrangement has been found to improve the signal sensitivity of the mass spectrometer results in the order of 10-100 times that compared with conventional ICP-MS sampler interface arrangements. Therefore, using the arrangement of the present invention, suitable collisional gases may be introduced and maintained in the collisional region 30 at higher pressures (thereby increasing the removal rate of unwanted particles) while reducing the rate of scatter of incoming and available ions. The remaining ions are extracted by extraction lens 42 and directed to the mass spectrometer detector 6 for analysis.

Skimmers (26), as used in typical ICP-MS configured mass spectrometers, are generally constructed from metal and arranged to be electrically associated with a metallic vacuum chamber. This ensures the skimmer 26 is constantly grounded at substantially zero (0) voltage potential. However, in accordance with the present invention, applying a bias voltage potential to the skimmer 26 provides the additional energy potential to the ions extracted from the plasma. For example, if the kinetic energy loss within the collisional region 30 is found to be in the order of 25 electron Volts (eV), this loss can be compensated for by applying a voltage potential of around +25 Volts (V) to the skimmer 26. In cases where a quadrupole mass analyzer is incorporated downstream of the skimmer 26, further benefits in addition to the reduction of collisional scatter may also be realized. In such cases, the quadrupole mass-analyser does not need to be offset (in this case by a voltage potential of −25V) in order to assist with the transfer of ions (having reduced kinetic energy). Instead, the potential of the mass analyzer can be maintained at a substantially normal (zero) voltage potential thereby simplifying the operation of the apparatus. Therefore, there is no need to adjust the quadrupole voltage bias (as would normally be required) in order to assist with the transport of the ions through the quadrupole mass analyser.

In the case of a conventional ICP-MS configuration, when a collision or reactive gas is used in a CRI atmosphere, a reduction in sensitivity due to collisional scatter can be observed to be in the order of from 10-100 times during operation. However, the application of a bias voltage potential to the skimmer, as arranged in accordance with present invention, is thought to have the potential to reduce the energy losses of the ion beam resulting in an improvement in signal sensitivity in the order of from 10 to 50 times. It will be appreciated that any magnitude of voltage potential may be applied to the skimmer 26.

The use of collision cells in conventional ICP-MS devices has been found to increase the signal sensitivity of the ion beam by 10-100 times compared with arrangements where they are absent. For mass spectrometry instrumentation devices incorporating collision cells, application of a bias voltage potential to the skimmer has also been found to be advantageous as the collision cell typically operates in a relatively high pressure environment where ion kinetic energy losses can be substantial—up to 200 eV per ion. Such collision cells generally include quadrupole mass analysers or similar arranged therewith. This therefore means that ions passing through such collision cell arrangements need to be extracted using negatively charged ion extraction lenses installed behind the collision cell, and a large negative bias voltage potential applied to the quadrupole mass-analyser. However, in accordance with the present invention, the kinetic energy losses of the ions can be compensated for, or controlled to a reasonable degree, if a similar bias voltage potential (proportional to that which the collision cell consumes) is applied to the skimmer thereby increasing the initial energy state of the ions in the ion beam (for example, up to in the order of +200 eV per ion). This has been found to improve the signal sensitivity in the order of between 10-100 times.

In view of the above, and without being bound by preliminary results, it will be appreciated that a correlation exists between the pressure of the collision gas 34 in the collisional region 30 (or the collision cell), and the bias voltage potential to be applied to the skimmer 26. In this regard, it may be appreciated that the lower the pressure in the collisional region 30 (indicative of less collisional scatter), the lower the bias voltage potential required to be applied to the skimmer 26. Moreover, the higher the pressure in the collisional region 30 (indicate of increased collisional scatter), the more bias voltage potential might be required to be applied to the skimmer 26. For example, an increase in the pressure of the gas in the downstream region may cause a commensurable increase in the number of ionic collisions which occur. Therefore, in one embodiment, an increase in bias voltage potential applied to the skimmer 26 may be selected so as to be commensurable with the increase in the pressure of the gas in the downstream region. However, the commensurable increase in the number of ionic collisions (as a result of the increase in gaseous pressure in the downstream region) may not translate to the same increase in collisional scatter of the ions. This is because collisional scatter is generally a function of ion energy and/or the speed of an ion prior to a collision. Accordingly, the bias voltage potential to be applied to the skimmer 26 is generally a function of the collisional scatter of the ions due to ionic collisions and may be selected experimentally (discussed further below) so as to determine the magnitude of the bias voltage potential which results in the maximum possible number of ions reaching the spectrometer detector 6.

The magnitude of the bias voltage potential applied to the skimmer 26 (or multiple skimmers as discussed below and shown in the embodiment presented in FIG. 6) is generally determined experimentally by reference to the collisional pressure recorded in the second chamber 35 (or collisional pressure in the collision cell when included in the arrangement), and the resulting signal sensitivity or strength of the ion beam received by the mass spectrometer. One method of determining the optimum level of bias voltage potential to be applied to the skimmer 26 is by first, in the absence of any bias voltage potential applied to the skimmer 26, removing any collisional gas from the ion beam path and observing the signal sensitivity of the device. This provides an initial point of reference. Then, by introducing the desired collisional gas 34 into the collisional region 30, the signal sensitivity can be monitored as the bias voltage potential applied to the skimmer 26 is slowly increased. With increases in applied bias voltage potential to the skimmer 26, the signal sensitivity can be shown to improve. However, it has been found that a turning point will be reached where further increases in bias voltage potential serve to reduce the signal sensitivity, ie. energising the ions too much causing increased collisional activity. Accordingly, a bias voltage potential commensurate with the 'turning point' will be a likely reflection of the optimum bias voltage potential to be applied to the skimmer 26. Furthermore, it may be that a bias voltage potential level selected within a range or band of voltage levels may prove optimal depending on the specific sampling interface arrangement used. It will also be appreciated that the optimum voltage levels (or band of voltage levels) may differ between sample ions and therefore may be characteristic of certain types of elements.

Depending on the nature of the sample ions, the relationship between the pressure of the gas in the collisional region 30 and the bias voltage potential to be applied to the skimmer 26 may be linear or non-linear, and may further depend on other factors such as, for example, the ion and collisional gas properties, and any relevant chemistry such as the ion energy, collisional, and vibrational properties. It will be appreciated that these factors are not intended to be exhaustive and that other factors may further complicate the nature of the relationship between the pressure of the gas in the collisional region 30 and the applied bias voltage potential.

Other means may also be used for determining the optimum level of the bias voltage potential. Pressure sensors (such as any suitable form of pressure transducer having sufficient sensitivity to acknowledge pressure due to colliding ions) may be located at locations throughout the collisional region 30 and arranged to transmit pressure data to a processing unit (not shown) suitably programmed to process the data and automatically adjust the applied bias voltage potential when required. The processing unit may also be arranged to receive data relating to the signal sensitivity of the device. Therefore, when provided with these data inputs, the process of determining the optimum bias voltage potential can be readily automated. It will be appreciated that similar pressure sensor and data processing arrangements may be provided in collision cells for monitoring and/or estimating collisional activity.

Plasma sampling interface arrangements in accordance with the present invention may be used with various ICP-MS configurations as exemplified in the embodiments shown in each of FIGS. 2 to 6 which are discussed in detail below.

Figure 2:
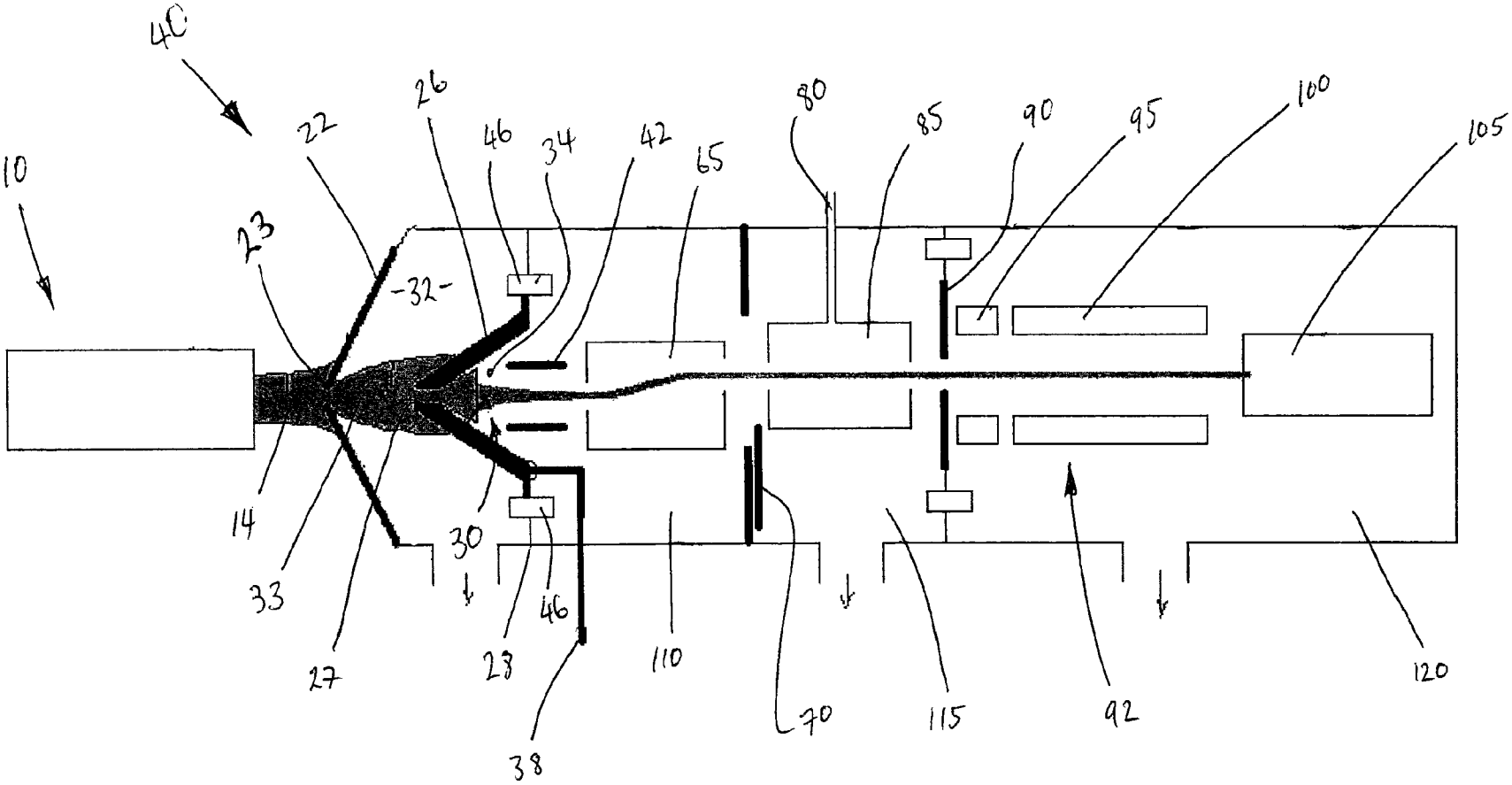
FIG. 2 shows a schematic representation of another embodiment of an ICP-MS apparatus arranged in accordance with another embodiment of the present invention.

FIG. 2 shows a sampling interface 40 arranged in accordance with the present invention. For the arrangement shown, the sampling interface 40 is configured with a two aperture ICP-MS 'Campargue' interface arrangement similar to that shown in FIG. 1. As will be clear from FIG. 2, the sampling interface 40 shares a similar arrangement of components with the embodiment of the sampling interface 2 shown in FIG. 1.

As the ions pass through the aperture 27 provided in the skimmer 26, they enter the collisional region 30 defined by the second vacuum chamber 35 within which the collisional gas 34 is held. Ions which are not affected by scatter due to collision with particles of gas pass into an ion optics chamber 65 contained within a first pumping compartment 110. The ion optics chamber 65 assists with the separation from the ions of any UV photons, energetic neutrals or any solid particles that may have been carried into the instrument from the ICP, and which inadvertently avoided collision with the particles of the collisional gas 34. For the embodiment shown, the ion optics chamber 65 is arranged as an off axis configuration which acts to 'bend' the ion beam in a 'chicane' like manner. Such lens arrangements used may comprise the Omega lens (Agilent 7700 ICP-MS or the chicane lens (Thermo ICP-MS) ion optics arrangement). Ion optic arrangements of this nature seek to ensure that non-charged particles do not follow the charged ions and are removed from the ion beam (for example by colliding with an internal surface of the ion optics chamber 65).

From the ion optics chamber 65, the ion beam is directed through a gate valve 70 to a further collisional atmosphere provided within a collision cell 85 (typically also referred to in the art as collisional cells, ion fragmentation cells, or ion manipulation cells), contained within a second pumping compartment 115. Collision cells typically hold one or more pressurized gases such as ammonia, methane, oxygen, nitrogen, argon, neon, krypton, xenon, helium or hydrogen which reacts with the ions as an additional means of eliminating unwanted residual interfering particles. The gas(es) are introduced into the collision cell 85 by way of inlet 80. The collision cell 85 may be arranged to either hold one of the gases or a combination of two or more. It will be appreciated that the latter mentioned gases are by no means exhaustive and that many other gases, or combinations thereof, may be suitable for use in such collision cells.

From the collision cell 85, the ion beam passes through a differential pumping aperture 90, held within a third pumping chamber 120, toward a mass analyzer arrangement (in this instance a quadrupole mass analyzer arrangement) 92. The quadrupole mass analyzer arrangement 92 comprises a first set of rods (quadrupole fringing rods 95), and a second set of rods (quadrupole main rods 100) located downstream of the quadrupole fringing rods 95. In this instance, the sets of quadrupole fringing 95 and main rods 100 each comprise four (4) rods arranged parallel one another having their respective axes arranged parallel with the direction of travel of the ion beam. The function of the quadrupole mass analyzer arrangement 92 is to filter the ions in the ion beam based on their mass-to-charge ratio (m/z). For the quadrupole mass analyzer arrangement 92 shown, sample ions are separated based on their stability of their trajectories in the oscillating electric fields that are applied to the rods. The remaining ions (charged ions) are then directed toward a mass spectrometer detector unit 105 for analysis.

Figure 3:
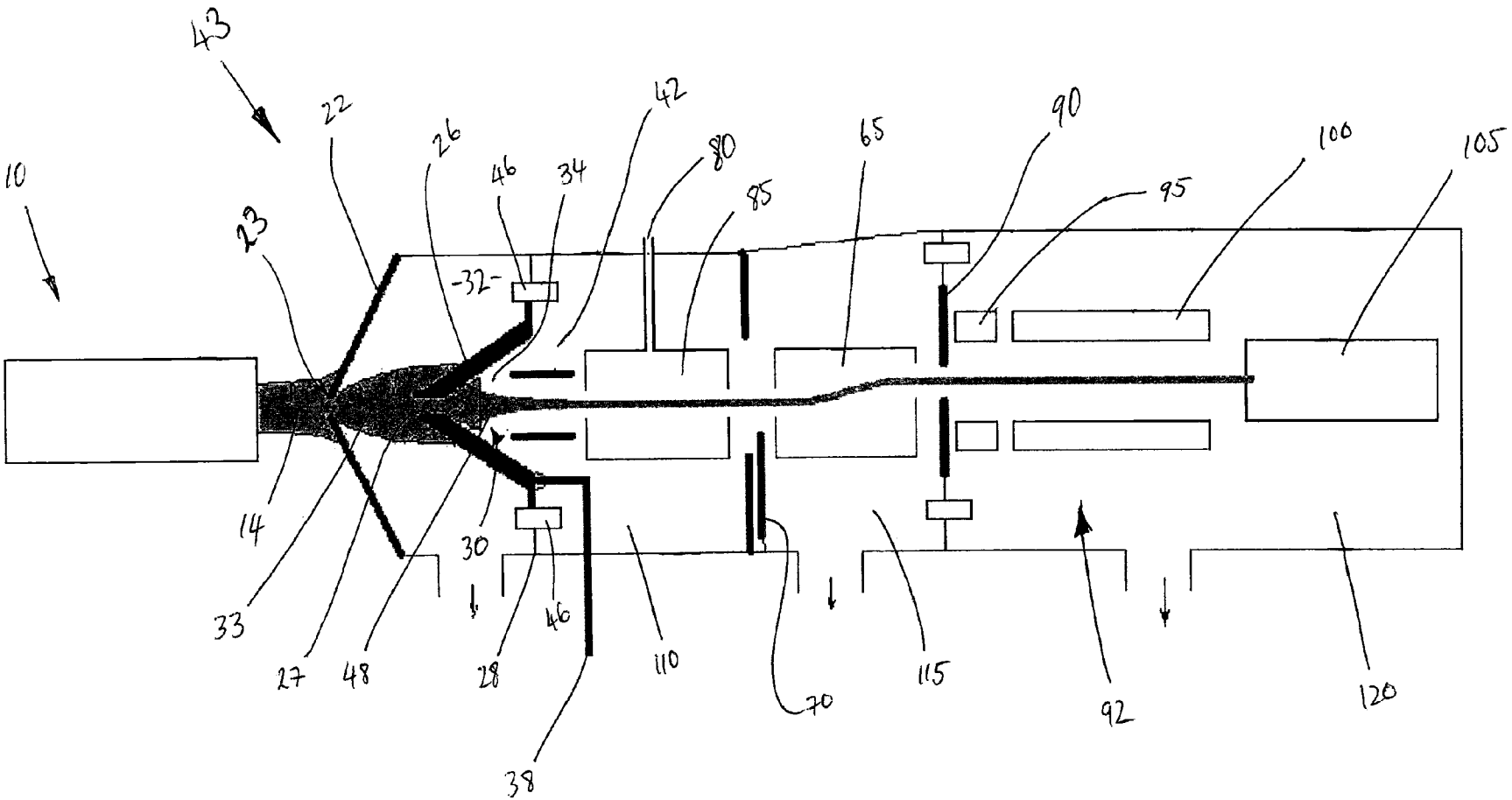
FIG. 3 shows a variation of the embodiment of the ICP-MS apparatus shown in FIG. 2.

FIG. 3 shows an embodiment of a sampling interface 43 arranged in accordance with the present invention. As will again be clear from FIG. 3, the sampling interface 43 is a variation of the embodiment (40) shown in FIG. 2 in which the ion optics chamber 65 is arranged to reside within the second pumping chamber 115 downstream of the collision cell 85 (now in the first pumping chamber 110).

Figure 4:
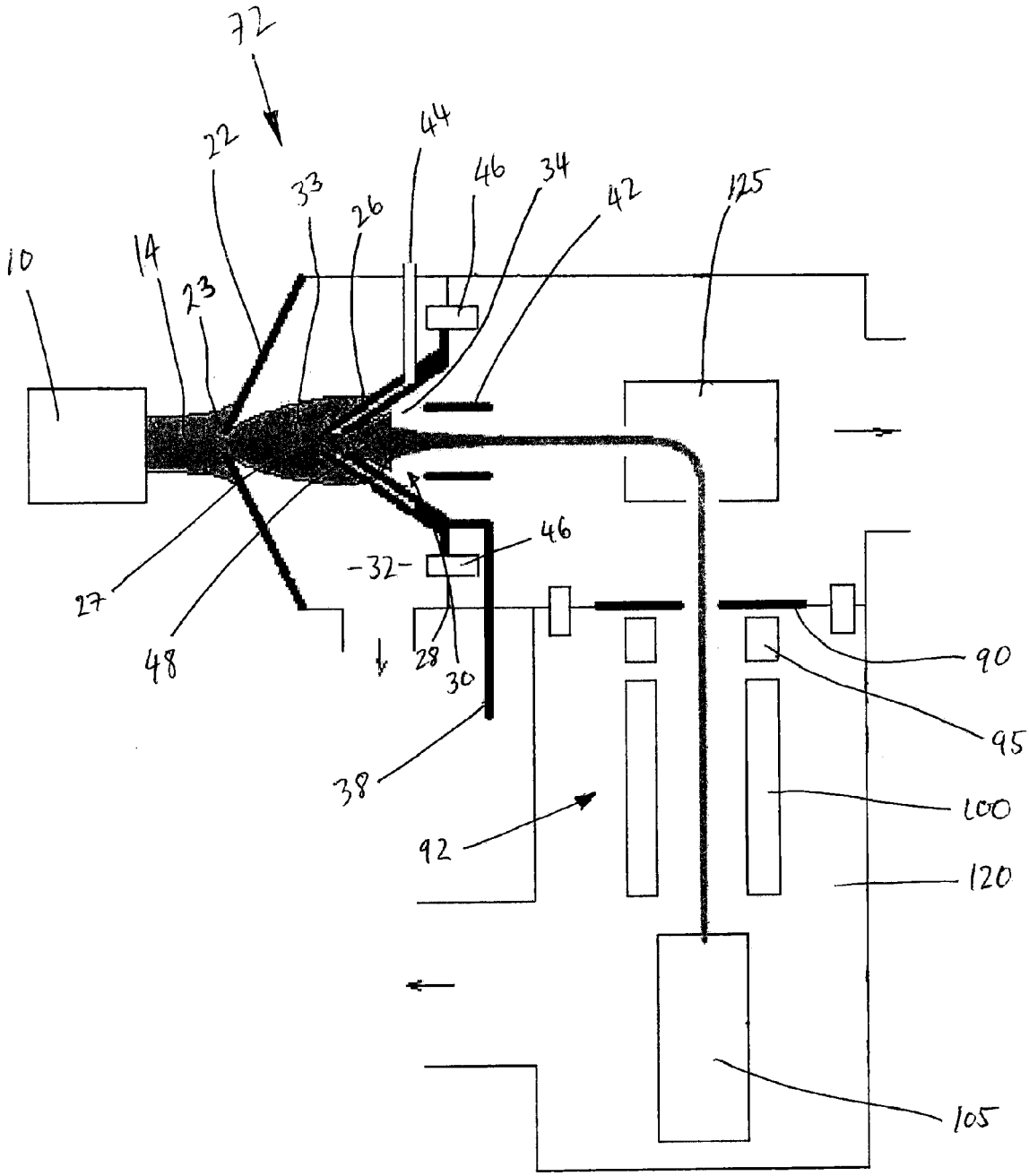
FIG. 4 shows a schematic representation of another embodiment of an ICP-MS apparatus arranged in accordance with yet another embodiment of the present invention.

FIG. 4 shows an embodiment of a sampling interface 72 also arranged in accordance with the present invention. Similarly, many of the components shown are shared with the embodiments shown in FIGS. 1 to 3, however, a modified skimmer 26 is provided having an inlet 44 which is arranged to inject the collisional gas (such as helium or hydrogen) into the plasma field 33 at or near the aperture 27 of the skimmer 26. It will be appreciated that such collisional gases may be injected into the chamber atmosphere at any suitable and desirable location within the interface.

An additional difference, as compared with the embodiment of the plasma sampling interface 43 shown in FIG. 3, is the incorporation of an ion 'mirror' lens 125 arranged to redirect the ion beam toward the quadrupole mass analyzer 92 which is positioned in an off-axis relationship relative to the direction of travel of the ion beam from the skimmer 26. As the ion beam travels downstream from the skimmer 26, the ion mirror 125 is arranged having a set of electrodes configured to direct the charged particles in the ion beam to follow a different path to the accompanying non-charged particles. The electrodes in the ion mirror 125 may be arranged so that the ion beam can be diverted (reflected) through a substantial angle, for example 90 degrees (as shown in FIG. 4). As such, any photons or energetic neutrals that originally accompanied the ion beam as it emerged from the skimmer 26 continue in their original direction and removed from the ion beam. It will be appreciated that arrangements of this nature can be advantageous in that the electrodes can be configured so a degree of control can be exercised over the direction of travel of the ion beam. For example, the ion beam can be steered from side to side (ie. into or out of the plane of the drawing) by applying a voltage differential to opposite electrodes of the ion mirror 125. Further reference in this regard is made to U.S. Pat. No. 6,762,407 which is incorporated herein by reference. Use of the ion mirror 125 has been shown to increase the signal sensitivity of mass spectrometry devices.

Figure 5:
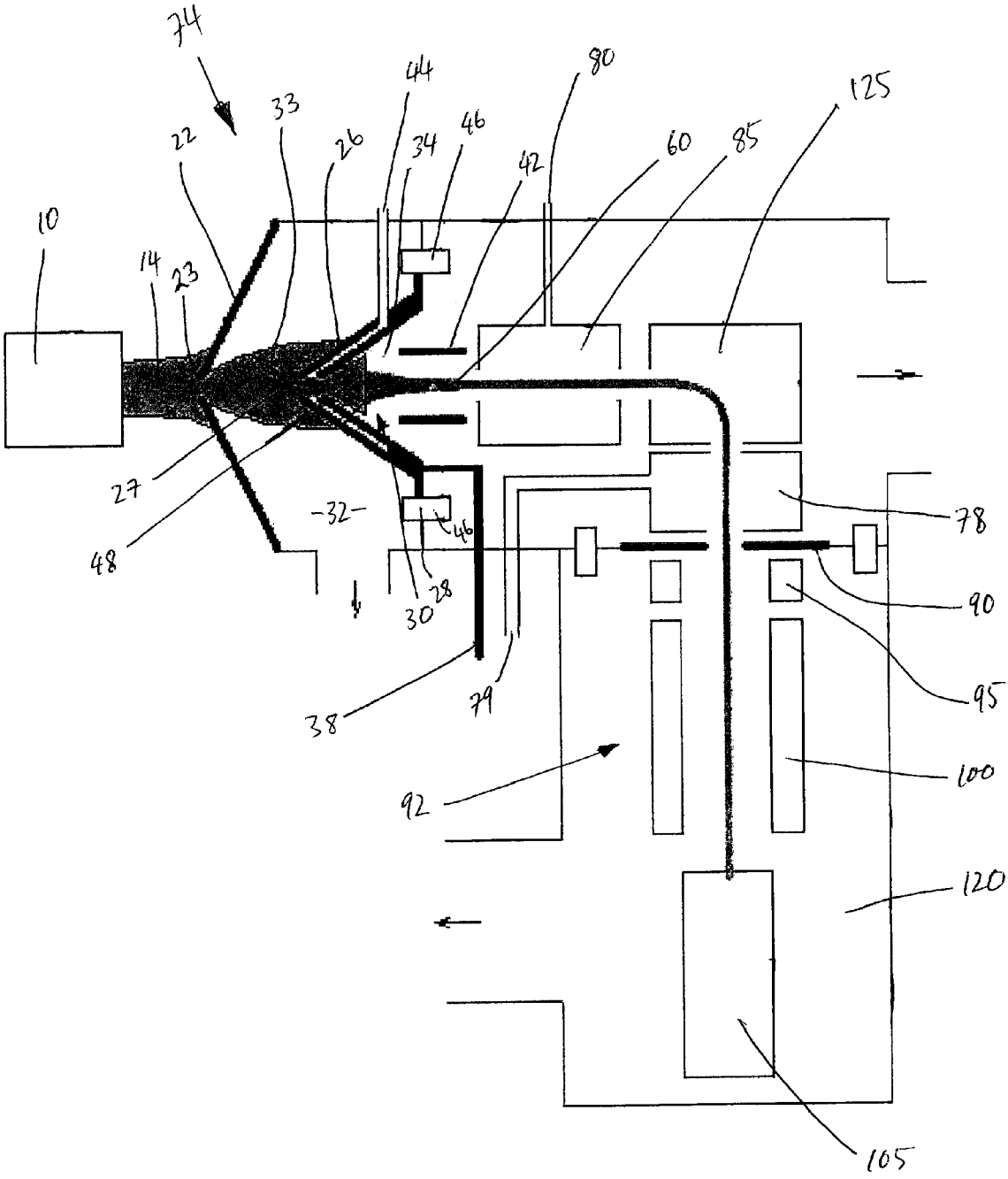
FIG. 5 shows a variation of the embodiment of the ICP-MS apparatus shown in FIG. 4; and, FIG. 6 shows another variation of the embodiment of the ICP-MS apparatus shown in FIG. 5.

FIG. 5 shows an embodiment of a sampling interface 74 arranged in accordance with the present invention. As will be clear from FIG. 5, the arrangement is substantially similar to that shown in FIG. 4, however, it will be noted that the sampling interface 74 includes collision cell 85 arranged intermediate the extraction lens 42 and the ion mirror 125. A further difference is the provision of a second collision cell 78 which is positioned intermediate the ion mirror 125 and the entry into the quadrupole mass analyzer 92. It will be appreciated that the second collision cell 78 provides a further means of filtering any remaining interfering particles that may have been inadvertently diverted with the ion beam by the ion mirror 125. The second collision cell 78 is arranged to receive a collisional gas via inlet 79. Although the second collision cell 78 is provided for further refinement of the ion beam, it will be appreciated that arrangements could be realized in which it is the only collision cell provided, ie. collision cell 85 may be omitted in favour of the second collision cell 78. The skilled person will further appreciate that the gases held within collision cells 85 and 78 may be the same type of gas, different gases, or comprise a combination of one or more suitable gases.

Figure 6:
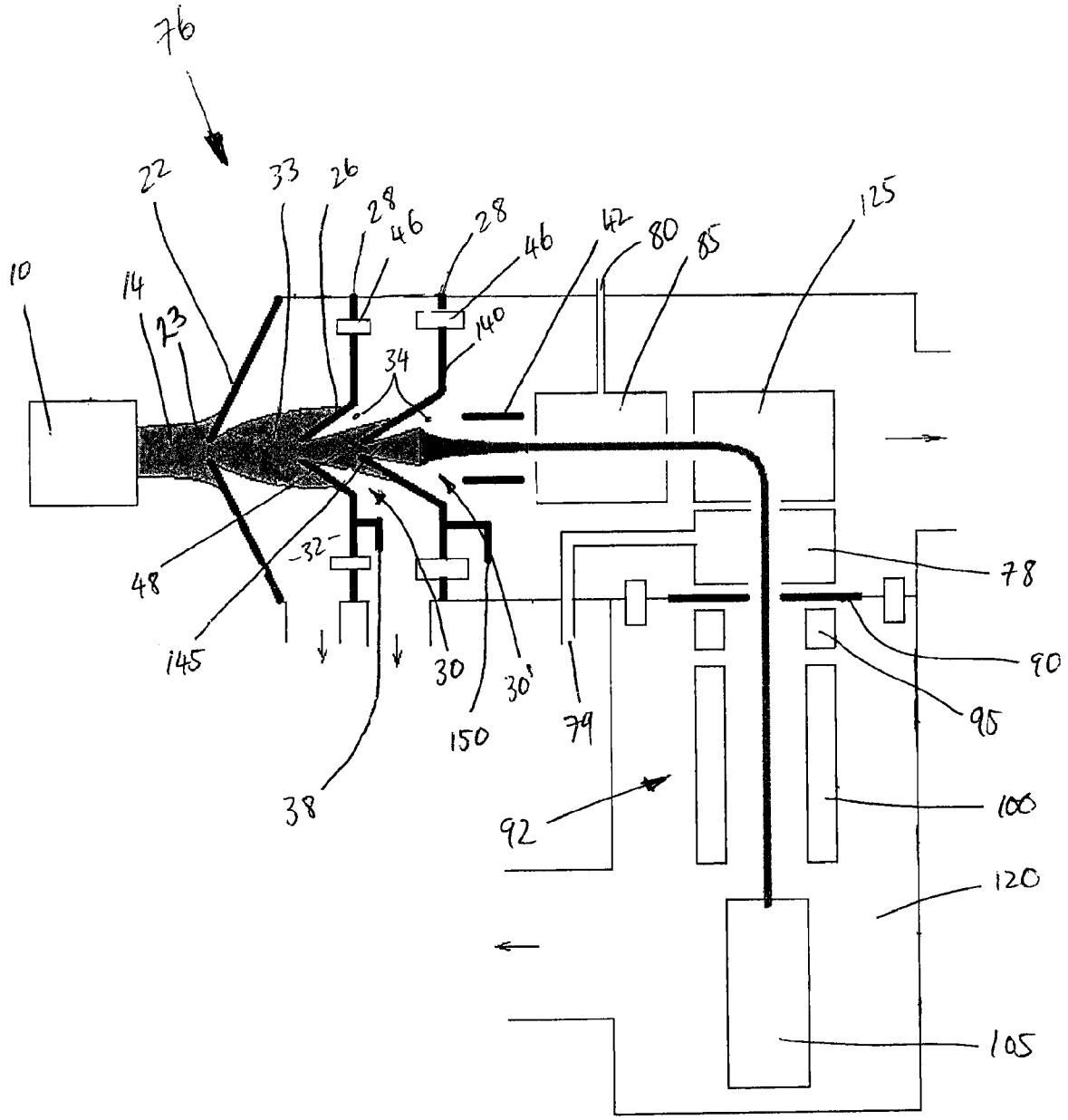

FIG. 6 shows an embodiment of a sampling interface 76 arranged in accordance with the present invention. In this embodiment, a second skimmer 140 has been included and positioned intermediate skimmer 26 and the extractions lens 42. A further voltage source 150 is provided so that a bias voltage potential may be suitably applied to the second skimmer 140.

The inclusion of the second skimmer 140 affords a further stage in which the ion beam may be refined by removing any unwanted particles. It will be seen that a further plasma expansion region 145 forms immediately downstream of the second skimmer 140 as the plasma passes en-route to a further collisional region 30. In addition, the second skimmer 140 is also arranged to 'float' so that a bias voltage potential may be applied thereto in order to re-energise the sample ions as they pass from skimmer 26. It will be appreciated that additional skimmers may be provided and arranged in an appropriate series configuration so as to further refine the ion beam as required. Furthermore, with reference to the skimmer 26 arrangement shown in FIGS. 4 and 5, it will be appreciated that both skimmers 26 and 140 could also be modified so that a suitable gas may be injected from the periphery of respective apertures into the passing ion beam.

The word 'comprising' and forms of the word 'comprising' as used in this description and in the claims does not limit the invention claimed to exclude any variants or additions. Modifications and improvements to the invention will be readily apparent to those skilled in the art. Such modifications and improvements are intended to be within the scope of this invention.

The claims defining the invention are as follows:

1. A sampling interface for use with a mass spectrometry apparatus, the sampling interface being arranged so as to enable the sampling of ions in a mass spectrometer for subsequent spectrometric analysis, the sampling interface comprising:

an inlet for receiving a quantity of ions from an ion source;

a skimmer that is arranged downstream of the inlet and that has an aperture through which ions from the inlet pass;

a chamber downstream from the skimmer with a region that contains a collision gas that is encountered by ions passing through the skimmer aperture; and an adjustable voltage source that applies a bias voltage to the skimmer to generate a field having a selected bias voltage potential in at least a portion of said chamber region, a magnitude of the bias voltage being selected in accordance with a measured system parameter so as to minimize collisional scattering of the ions encountering the collision gas.

2. A sampling interface according to claim 1, wherein the bias voltage is selected in accordance with a change in kinetic energy of the ions due to collisions with particles of the collision gas.

3. A sampling interface according to claim 1, wherein the bias voltage is selected in accordance with a pressure of the collision gas.

4. A sampling interface according to according to claim 1, wherein the interface is arranged in electrical communication with a voltage source.

5. A sampling interface according to claim 1, wherein the bias voltage potential of the field is variable in response to variations in the pressure of the gas.

6. A sampling interface according to claim 4, wherein the voltage potential of the field is provided by a chargeable element arranged so as to be electrically coupleable to the voltage source.

7. A sampling interface according to claim 6, wherein the chargeable element is arranged within the region so that the field is positioned relative to a desired pathway of the ions so that passing ions gain energy potential from the field.

8. A sampling interface according to claim 6, wherein the chargeable element includes an aperture provided therein through which ions may pass.

9. A sampling interface according to claim 6, wherein the chargeable element is arranged so as to be electrically isolated from ground.

10. A sampling interface according to claim 6, wherein the voltage applied to the chargeable element is a positive voltage potential.

11. A sampling interface according to claim 1, wherein the gas comprises at least one of helium or hydrogen or a mixture thereof.

12. A sampling interface according to claim 1, wherein the downstream region is, at least in part, defined by a chamber arranged to be sealed so that the enclosed gas or gases reside in the chamber under pressure.

13. A sampling interface according to claim 12, wherein the inlet is a sampler having a sampler cone, and the chargeable element is a skimmer having a skimmer cone.

14. A sampling interface according to claim 13, wherein the chamber is arranged adjacent a downstream face of the sampler.

15. A sampling interface according to claim 6, wherein the chargeable element includes an inlet through which gas is injected into the chamber.

16. A sampling interface according to claim 1, wherein the inlet for receiving said quantity of ions is substantially conical in shape having an aperture provided at or near the apex of the cone.

17. A sampling interface according to claim 6, wherein the chargeable element is substantially conical in shape having an aperture provided at or near the apex of the cone.

18. A sampling interface according to claim 17, wherein the apertures of the inlet and chargeable element are arranged so as to be substantially concentric with one another.

19. A sampling interface according to claim 1, wherein the ions are sourced from a plasma generated by an inductively coupled plasma (ICP).

20. A sampling interface according to claim 1, wherein the interface is arranged so as to be associable with at least one of the following mass spectrometry instrumentation: atmosphere pressure plasma ion source inductively coupled plasma mass spectrometry (ICP-MS), microwave plasma mass spectrometry (MP-MS) or glow discharge mass spectrometry (GD-MS) or optical plasma mass spectrometry, gas chromotography mass spectrometry (GC-MS), liquid chromotography mass spectrometry (LC-MS), and ion chromotography mass spectrometry (IC-MS), electron ionization (EI), direct analysis in real time (DART), desorption electrospray (DESI), flowing atmospheric pressure afterglow (FAPA), low temperature plasma (LTP), dielectric barrier discharge (DBD), helium plasma ionization source (HPIS), spheric pressure photo-ionization (DAPPI), and atmospheric description ionization (ADI).

21. A mass spectrometer having a sampling interface arranged according to claim 1.

22. An inductively coupled plasma mass spectrometer having a sampling interface according to claim 1.

23. A plasma sampling interface for a plasma mass spectrometry apparatus, the plasma sampling interface arranged so as to enable the sampling of ions from a plasma and introduction of the ions to a mass spectrometer for subsequent spectrometric analysis, the ions to be sampled being from a sample which has been converted into ions in the plasma, the plasma sampling interface comprising:

a sampler arranged adjacent the plasma for receiving ions therefrom; and a skimmer that is arranged downstream of the sampler and that has an aperture through which ions from the sampler pass;

a chamber downstream from the skimmer with a region that contains a collision gas that is encountered by ions passing through the skimmer aperture; and an adjustable voltage source that applies a bias voltage to the skimmer to generate a field having a selected bias voltage potential in a said chamber region, a magnitude of the bias voltage being selected in accordance with a measured system parameter so as to minimize collisional scattering of the ions encountering the collision gas.

24. A plasma sampling interface according to claim 23, wherein the sampler and skimmer are arranged so as to enable sampling of the ions from the plasma for introduction to the mass spectrometer.

25. A plasma sampling interface according to claim 23, wherein the bias voltage is selected in accordance with a change in kinetic energy of the ions due to collisions with particles of the collision gas.

26. A plasma sampling interface according to claim 23, wherein the bias voltage is selected in accordance with a pressure of the collision gas.

27. A method for attenuating directional deviation of ions of a directed ion beam from a desired pathway in a mass spectrometer having an ion source for producing the directed ion beam, detection means, at least one apertured interface between the ion source and the detection means through which the directed ion beam passes, and a chamber into which a gas is capable of being introduced, the method comprising applying a voltage to bias ions of the directed ion beam in the direction of the desired pathway as the directed ion beam passes into the chamber downstream of the apertured interface.

28. A method for controlling the desired pathway of ions of a directed ion beam in a mass spectrometer having an ion source for producing the directed ion beam, detection means, at least one apertured interface between the ion source and the detection means through which the directed ion beam passes, and a chamber into which a gas is capable of being introduced, the method comprising creating an electrical field in the region of the apertured interface so as to bias ions of the directed ion beam towards the desired pathway as the directed ion beam passes into the chamber downstream of the apertured interface.

29. A sampling interface for use in sampling ions in a mass spectrometer having an ion source for producing a directed ion beam along a desired pathway, detection means, and a chamber into which a gas is capable of being introduced, the interface being apertured and electrically coupleable to a voltage source so as to bias ions of the directed ion beam towards the desired pathway as the directed ion beam passes into the chamber downstream of the apertured interface.

30. A mass spectrometer having an ion source for producing a directed ion beam along a desired pathway, detection means, at least one apertured interface between the ion source and the detection means through which the directed ion beam passes, and a chamber downstream of the apertured interface into which a gas is capable of being introduced, wherein the apertured interface is electrically coupleable to a voltage source so as to bias ions of the directed ion beam towards the desired pathway as the directed ion beam passes into the chamber downstream of the apertured interface.

* * * * *